US007690769B2

(12) United States Patent
Katayama

(10) Patent No.: US 7,690,769 B2
(45) Date of Patent: Apr. 6, 2010

(54) INKJET PRINTER HEAD WITH INK-FLOW GROOVES ON THE WALL OF THE COMMON INK CHAMBER

(75) Inventor: Naoki Katayama, Kariya (JP)

(73) Assignee: Brother Kogyo Kabushiki Kaisha, Aichi-Ken (JP)

( * ) Notice: Subject to any disclaimer, the term of this patent is extended or adjusted under 35 U.S.C. 154(b) by 442 days.

(21) Appl. No.: 11/269,490

(22) Filed: Nov. 7, 2005

(65) Prior Publication Data

US 2006/0098046 A1 May 11, 2006

(30) Foreign Application Priority Data

Nov. 8, 2004 (JP) ..... 2004-323345

(51) Int. Cl.
*B41J 2/05* (2006.01)

(52) U.S. Cl. ..... 347/65; 347/92; 347/93; 347/54

(58) Field of Classification Search ..... 347/92–94, 347/86–87, 65, 54
See application file for complete search history.

(56) References Cited

U.S. PATENT DOCUMENTS 6,019,464 A * 2/2000 Tsukada et al. ..... 347/92
6,364,466 B1 * 4/2002 Chen et al. ..... 347/65
6,749,296 B2 6/2004 Usui et al.
2002/0109762 A1 * 8/2002 Usui et al. ..... 347/93

FOREIGN PATENT DOCUMENTS

JP A-2-4515 1/1990
JP A 11-20186 1/1999
JP A-11-227228 8/1999

* cited by examiner

*Primary Examiner*—Matthew Luu
*Assistant Examiner*—Henok Legesse
(74) *Attorney, Agent, or Firm*—Eugene LeDonne; Joseph W. Treloar; Frommer Lawrence & Haug

(57) ABSTRACT

A recording head for use in an inkjet recording device, the recording head including a cavity unit having a plurality of nozzles each of which ejects a droplet of an ink, a plurality of communication holes which communicate with the plurality of nozzles, respectively, and a common ink chamber which communicate with each of the communication holes and which temporarily stores the ink to be supplied to the each of the nozzles via a corresponding one of the communication holes. The cavity unit has at least one inner wall surface which defines the common ink chamber and has respective open ends of the communication holes. The at least one inner wall surface further has a plurality of grooves each of which is connected, at one end thereof, to the open end of a corresponding one of the communication holes.

13 Claims, 12 Drawing Sheets

INKJET PRINTER HEAD WITH INK-FLOW GROOVES ON THE WALL OF THE COMMON INK CHAMBER

The present application is based on Japanese Patent Application No. 2004-323345 filed on Nov. 8, 2004, the contents of which are incorporated herein by reference.

BACKGROUND OF THE INVENTION

1. Field of the Invention

The present invention relates to an inkjet printer head, i.e., a recording head for use in an inkjet recording device.

2. Discussion Of Related Art

As one of recording devices that record an image on a recording medium such as a recording sheet, there has conventionally been known an inkjet printer that ejects droplets of ink toward a recording medium and thereby records an image on the medium. Recently there has been a tendency that the inkjet printer employs an increased number of ink ejection nozzles to perform recording (i.e., printing) at an increased speed. Accordingly the inkjet printer employs an increased number of pressure chambers (i.e., individual ink chambers) corresponding to the increased number of ink ejection nozzles, respectively. In the case where the inkjet printer is for recording a full-color image, the inkjet printer employs a plurality of groups of pressure chambers corresponding to a plurality of color inks (e.g., cyan, magenta, yellow, and black inks), respectively, and a plurality of manifolds (i.e., common ink chambers) each of which supplies a corresponding one of the color inks to a corresponding group of pressure chambers. In this case, each of the manifolds is provided in the vicinity of the corresponding group of pressure chambers.

FIG. 10 shows a recording head 101 for use in a conventional inkjet recording device. The recording head 101 includes a cavity unit 131 and a piezoelectric actuator 151. The cavity unit 131 has a plurality of nozzle holes 141*a* (i.e., ink ejection nozzles) that eject droplets of an ink; a plurality of pressure chambers 149*a* (i.e., individual ink chambers) that communicate with the nozzle holes 141*a*, respectively; and a manifold (i.e., a common ink chamber), that is, a pair of manifold holes 144*a*, 145*a* that temporarily stores the ink and supplies the ink to each of the pressure chambers 149*a*. The piezoelectric actuator 151 changes a pressure of the ink in each of the pressure chambers 149*a* and thereby ejects, from a corresponding one of the nozzle holes 141*a*, a droplet of the ink toward a recording sheet.

The cavity unit 131 includes a nozzle sheet 141, and a stacked structure consisting of a plurality of stacked sheets. Those stacked sheets include a spacer sheet 142; a damper sheet 143; two manifold sheets 144, 145; a ceiling sheet 146; an aperture sheet 147; a base sheet 148; and a cavity sheet 149, and are bonded with an adhesive to each other. Communication holes 146*a*, 148*a* and communication passages 147*a* through which the pair of manifold holes 144*a*, 145*a* communicates with the pressure chambers 149*a*, respectively, are formed in the sheets 146, 148, 147; and communication holes 142*a*, 143*b*, 144*b*, 145*b*, 146*b*, 147*b*, 148*b* through which the pressure chambers 149*a* communicate with the nozzle holes 141*a*, respectively, are formed in the sheets 142, 143, 144, 145, 146, 147, 148. The damper sheet 143 has a recess 143*a* functioning as a damper chamber that damps vibration of the ink present in the pair of manifold holes 144*a*, 145*a*. The recess 143*a* opens toward the nozzle sheet 141.

Generally, the communication holes 146*a* are through-holes that are formed through the thickness of the ceiling sheet 146, and have a circular cross-section shape whose diameter ranges from 150 μm to 250 μm. Therefore, as shown in FIG. 11, if a small air bubble, B1, whose diameter ranges from 0.3 mm to 1.0 mm, flows from an upstream-side portion of the pair of manifold holes 144*a*, 145*a* toward a downstream-side portion of the same, and remains just under each of the communication holes 146*a*, the small air bubble B1 blocks or closes the each communication hole 146. Thus, the ink cannot be supplied to a corresponding one of the pressure chambers 149*a*, or ejected from a corresponding one of the nozzle holes 141*a*.

FIG. 12 shows such a large air bubble, B2, that blocks the pair of manifold holes 144*a*, 145*a* as a whole. In this case, as the ink is consumed through the nozzle holes 141*a* corresponding to the downstream communication holes 146*a* currently located on the downstream side of the large air bubble B2, the large air bubble B2 is moved downstream toward the downstream-side portion of the pair of manifold holes 144*a*, 145*a*. Since the large air bubble B2 is moved little by little, each communication hole 146*a* that has temporarily been closed by the air bubble B2 is again supplied with the ink, and accordingly the ink is again ejected from the corresponding nozzle hole 141*a*. However, when the large air bubble B2 reaches the downstream-side end of the pair of manifold holes 144*a*, 145*a*, the air bubble B2 becomes unable to move any more and stays there. Thus, the communication hole or holes 146*a*, provided around the downstream-side end of the pair of manifold holes 144*a*, 145*a*, remain closed by the large air bubble B2, and accordingly the ink cannot be ejected from the corresponding nozzle holes 141*a*.

The nozzle holes 141*a* that have failed because of staying of the air bubble B1, B2 can be restored to their normal condition, by being subjected to a known purging operation. However, if one or more nozzle holes 141*a* fail because of staying of the air bubble B1, B2 during a recording operation of the inkjet recording device, those nozzle holes 141*a* cannot be instantaneously subjected to the purging operation and cannot be restored to their normal condition.

Meanwhile, Japanese Patent Application Publication No. 11-20186 or its corresponding U.S. Pat. No. 6,749,296 proposes an inkjet recording device that employs, for the purpose of supplying, in spite of staying of air bubbles, a sufficient amount of ink to a recording head, a first ink supply passage that is provided with a plurality of radial ridges that are spaced from each other by an angular pitch assuring that the radial ridges can capture the air bubbles.

However, the inkjet recording device disclosed by the above-indicated document is one that additionally employs a second ink supply passage through which the ink flows from an ink cartridge toward the first ink supply passage; and a filter that is provided in an area where the first and second ink flow passages are connected to each other. Therefore, the disclosed technique cannot be used as a countermeasure to deal with the air bubbles B1, B2 produced in the pair of manifold holes 144*a*, 145*a* of the cavity unit 131 of the recording head 101.

SUMMARY OF THE INVENTION

It is therefore an object of the present invention to provide an inkjet printer head, i.e., a recording head for use in an inkjet recording device that is free of at least one of the above-indicated problems. It is another object of the present invention to provide a recording head that is free of the problem that ink cannot be ejected because of staying of an air bubble in a manifold (i.e., a common ink chamber) of a cavity unit.

According to a first aspect of the present invention, there is provided a recording head for use in an inkjet recording device, the recording head including a cavity unit having a plurality of nozzles each of which ejects a droplet of an ink, a plurality of communication holes which communicate with the plurality of nozzles, respectively, and a common ink chamber which communicate with each of the communication holes and which temporarily stores the ink to be supplied to the each of the nozzles via a corresponding one of the communication holes. The cavity unit has at least one inner wall surface which defines the common ink chamber and has respective open ends of the communication holes. The at least one inner wall surface further has a plurality of grooves each of which is connected, at one end thereof to the open end of a corresponding one of the communication holes.

In this recording head, each of the grooves has an elongate stepped portion. Therefore, even if an air bubble may stay around the elongate stepped portion, the air bubble keeps, because of its surface tension, its spherical shape taking the smallest surface area, and accordingly there is left, around the elongate stepped portion, an elongate space through which the ink can flow. Since each of the grooves, i.e., each of the elongate stepped portions is connected to the open end of a corresponding one of the communication holes, the ink can flow into the corresponding communication hole through the each group, i.e., the elongate space left.

Thus, even if air bubbles may stay in the common ink chamber, the grooves can normally function to conduct the ink, since each air bubble keeps its spherical shape because of its surface tension and cannot enter the grooves or the elongate stepped portions. Since the ink can flow into each of the communication holes through a corresponding one of the grooves, a corresponding one of the individual ink chambers can be stably supplied with the ink and accordingly a corresponding one of the nozzles can stably eject droplets of the ink.

According to a second aspect of the present invention, there is provided a recording head for use in an inkjet recording device, the recording head comprising a cavity unit having a plurality of nozzles which eject respective droplets of an ink toward a recording medium to record an image thereon, a plurality of individual ink chambers which communicate with the plurality of nozzles, respectively, a plurality of communication holes which communicate with the plurality of individual ink chambers, respectively, and a common ink chamber which communicates with each of the communication holes and temporarily stores the ink to be supplied to each of the individual ink chambers via a corresponding one of the communication holes; and an actuator which changes a pressure of the ink present in the each of the individual ink chambers so that a corresponding one of the nozzles ejects the droplet of the ink. The cavity unit has at least one inner wall surface which defines the common ink chamber and has respective open ends of the communication holes. The at least one inner wall surface further has a plurality of groups of straight ink-flow grooves, and the straight ink-flow grooves of each of the groups are connected, at respective one ends thereof, to the open end of a corresponding one of the communication holes such that the straight ink-flow grooves of the each group extend radially outward from the open end of the corresponding communication hole.

In the present recording head, the straight grooves are connected to the open end of each of the communication holes. Therefore, even if an air bubble may be present around the each communication hole, the ink can flow into the each hole through at least one of the straight grooves and accordingly can be supplied to a corresponding one of the pressure chambers or a corresponding one of the nozzles.

BRIEF DESCRIPTION OF THE DRAWINGS

The above and optional objects, features, and advantages of the present invention will be better understood by reading the following detailed description of the preferred embodiments of the invention when considered in conjunction with the accompanying drawings, in which.

DETAILED DESCRIPTION OF THE PREFERRED EMBODIMENTS

Hereinafter, there will be described a preferred embodiment of the present invention by reference to the drawings.

Figure 1:
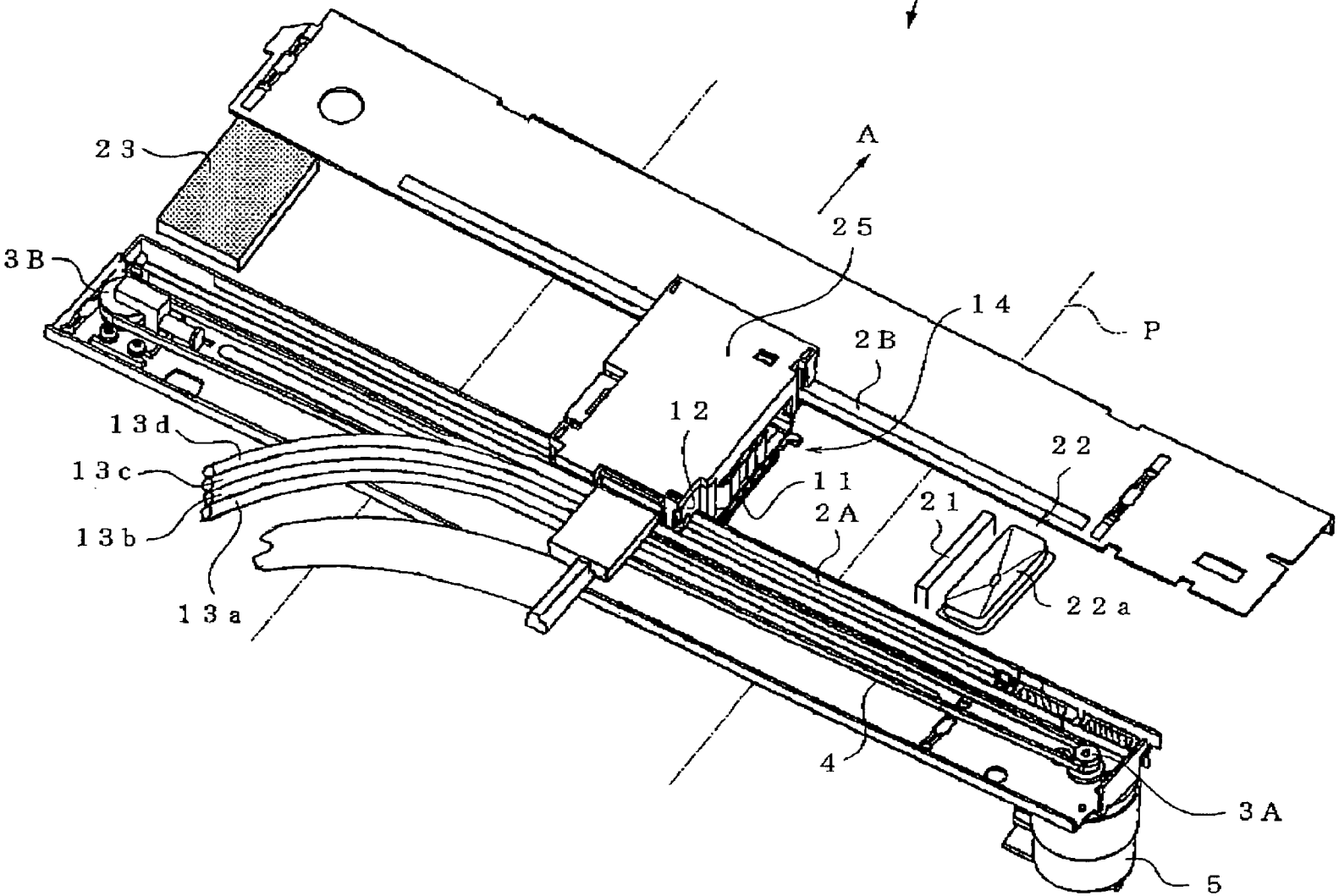
FIG. 1 is a perspective view of main constituent elements of an inkjet printer including a recording head to which the present invention is applied.
Figure 2:
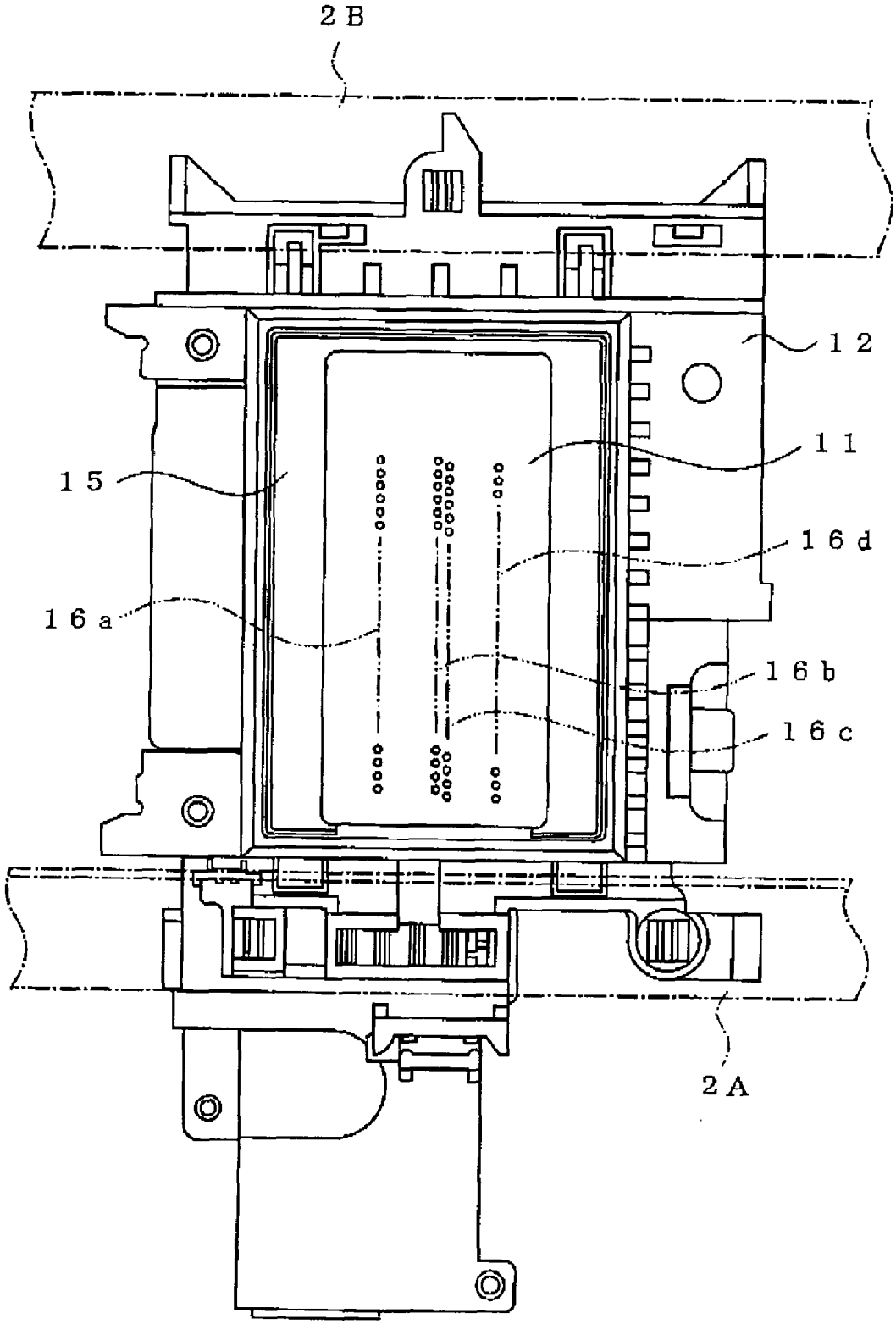
FIG. 2 is a bottom view of the recording head.

FIG. 1 shows main constituent elements of an inkjet printer 1 as a recording device; and FIG. 2 shows an inkjet-type recording head 11 that is employed by the inkjet printer 1 and to which the present invention is applied.

As shown in FIG. 1, the inkjet printer 1 includes the inkjet-type recording head 11 as a recording head that ejects, from ink ejection nozzles 16 (16*a*, 16*b*, 16*c*, 16*d*, FIG. 2), droplets of inks toward a recording sheet, P, as a sort of recording medium and thereby records an image on the sheet P. The inkjet printer 1 additionally includes a head holder 12 that holds the recording head 11. The head holder 12 also functions as a carriage that is moved relative to the recording sheet P. The head holder 12 additionally holds four buffer tanks 14 that temporarily store four color inks that are supplied from four ink tanks, not shown, via four ink supply tubes 13 (13*a*, 13*b*, 13*c*, 13*d*), respectively. The four color inks are then supplied from the buffer tanks 14 to the recording head 11. The ink tanks are detachably attached to an ink-tank supporter, not shown, that is fixed to a frame or housing, not shown, of the inkjet printer 1. Each of the ink tanks stores a large amount of color ink to be supplied to the recording head 11. For example, the four ink tanks store a black ink, a cyan ink, a magenta ink, and a yellow ink, respectively, so that the recording head 11 can record a full-color image on the recording sheet P.

The head holder 12 is supported by a rear guide member 2A and a front guide member 2B, such that the head holder 12 is movable relative to the two guide members 2A, 2B. The two guide members 2A, 2B are provided in the housing of the inkjet printer 1, such that the two guide members 2A, 2B extend parallel to each other. The rear guide member 2A has a generally L-shaped cross section taken along a plane perpendicular to the direction of movement of the head holder 12; and the front guide member 2B has a horizontal surface extending in the direction of movement of the head holder 12. The head holder 12 is connected to a portion of an endless timing belt 4 that is wound on a drive pulley 3A and a follower pulley 3B. When the drive pulley 3A is driven or rotated by an electric motor 5, the head holder 12 is reciprocated, on the two guide members 2A, 2B, with the timing belt 4. An upper end the head holder 12 is covered by a cover member 25. The recording sheet P is fed by a sheet feeding device, not shown, in a direction, A, (FIG. 1) perpendicular to the direction of movement of the head holder 12, through a recording position under the recording head 11 where images can be recorded on the sheet P.

FIG. 2 shows a lower surface of the recording head 11. The recording head 11 has, as viewed from left toward right, an array of ink ejection nozzles 16*a* corresponding to the black ink (BK), an array of ink ejection nozzles 16*b* corresponding to the cyan ink (C), an array of ink ejection nozzles 16*c* corresponding to the yellow ink (Y), and an array of ink ejection nozzles 16*d* corresponding to the magenta ink (M), such that the four nozzle arrays 16*a* through 16*d* extend in the direction A (i.e., a main-scan direction) perpendicular to the direction of movement of the head holder 12 (i.e., a sub-scan direction). The nozzles 16 are exposed in a downward direction so as to be opposed to an upper surface of the recording sheet P. A protector member 15 having a generally U-shaped configuration in its plan view is attached to the recording head 11, so as to protect the lower surface of the head 11, i.e., a "nozzle" surface of the head 11 where the nozzles 16 are exposed.

As shown in FIG. 1, in the housing of the inkjet printer 1, three sorts of maintenance units 21, 22, 23 are provided in two areas that are respectively located at two opposite ends of a movement range in which the head holder 12 is allowed to move. In the present embodiment, the three maintenance units 21, 22, 23 include a wiper member 21 and a purging device 22 that are provided in one of the two areas. The wiper member 21 is for wiping the nozzle surface of the recording head 11; and the purging device 22 performs a head recovering operation in which the purging device 22 selectively sucks each one of the four color inks from a corresponding one of the four nozzle arrays 16*a* through 16*d* of the recording head 11. The third maintenance unit 23, provided in the other area, is an ink receiving device which receives inks that are ejected (i.e., flushed) by the recording head 11 to prevent drying of the nozzles 16, periodically during an image recording operation of the head 11. In particular, the purging device 22 includes a cap member 22*a* that can air-tightly close the nozzle surface of the recording head 11, i.e., perform, as well known in the art, a capping operation in which the capping member 22*a* is moved upward to contact and air-tightly seal the nozzle surface, and a retracting operation in which the capping member 22*a* is moved downward away from the nozzle surface.

More specifically described, when a position detecting sensor, not shown, that is provided on a movement path of the head holder 12, detects that the recording head 11 (or the head holder 12) has been moved to a waiting position at one end of the movement range of the head holder 12, the cap member 22*a* is moved upward to a first height position where the cap member 22*a* can air-tightly seal the nozzle surface of the recording head 11 being positioned at the waiting position; and when the position detecting sensor detects that the recording head 11 is being positioned at any other position than the waiting position, the cap member 22*a* is moved downward from the first position to a second height position where the cap member 22*a* is away from the nozzle surface. Like a known maintenance unit, the cap member 22*a* is connected to a suction pump, not shown, so that the suction pump can suck, from the nozzles 16, inks having an increased viscosity, and/or foreign matters.

Figure 3:
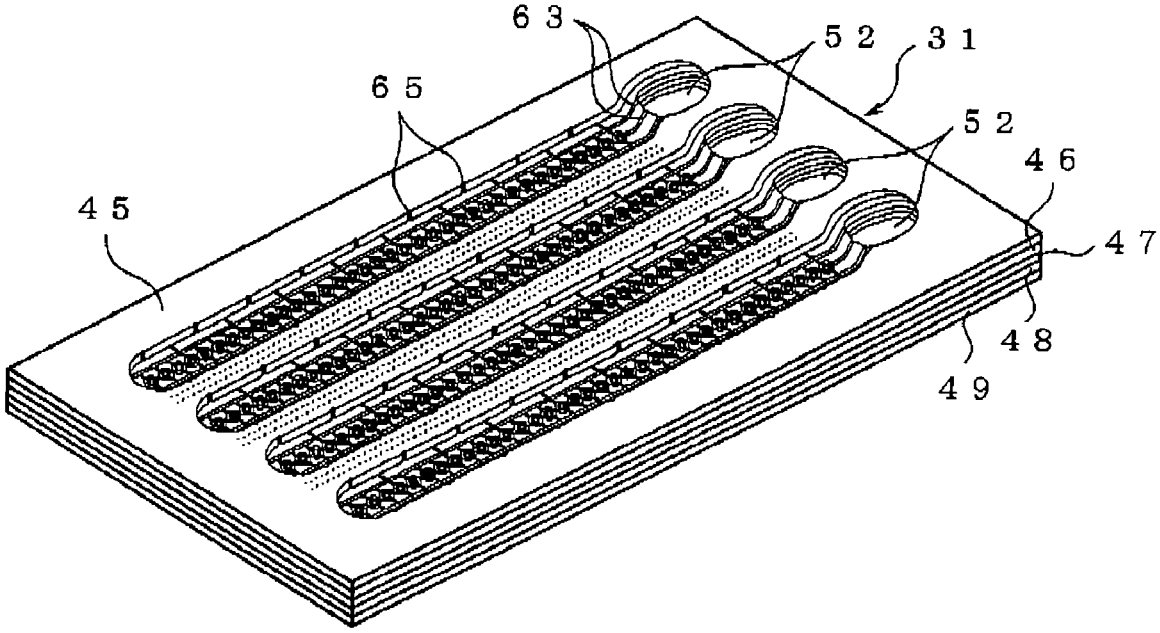
FIG. 3 is a perspective view of a cavity unit of the recording head.

The recording head 11 includes a cavity unit 31 a relevant portion of which is shown in FIG. 3. The cavity unit 31 has a cross section shown in FIG. 4. Like a conventional recording head, the present recording head 11 includes the cavity unit 31 having a plurality of nozzle holes 41*a* (i.e., the four arrays of nozzles 16*a* through 16*d*) that eject droplets of inks, a plurality of pressure chambers 49*a*, arranged in four arrays, that communicate with the nozzle holes 41*a*, respectively, and four pairs of manifold holes 44*a*, 45*a* each pair of which cooperate with each other to temporarily store a corresponding one of the four color inks and supply the corresponding color ink to the pressure chambers 49*a* of a corresponding one of the four arrays; and a piezoelectric actuator 51 that changes a pressure of the ink present in each of the pressure chambers 49*a* and thereby ejects, from a corresponding one of the nozzle holes 41*a*, a droplet of the ink toward the recording sheet P.

Figure 10:
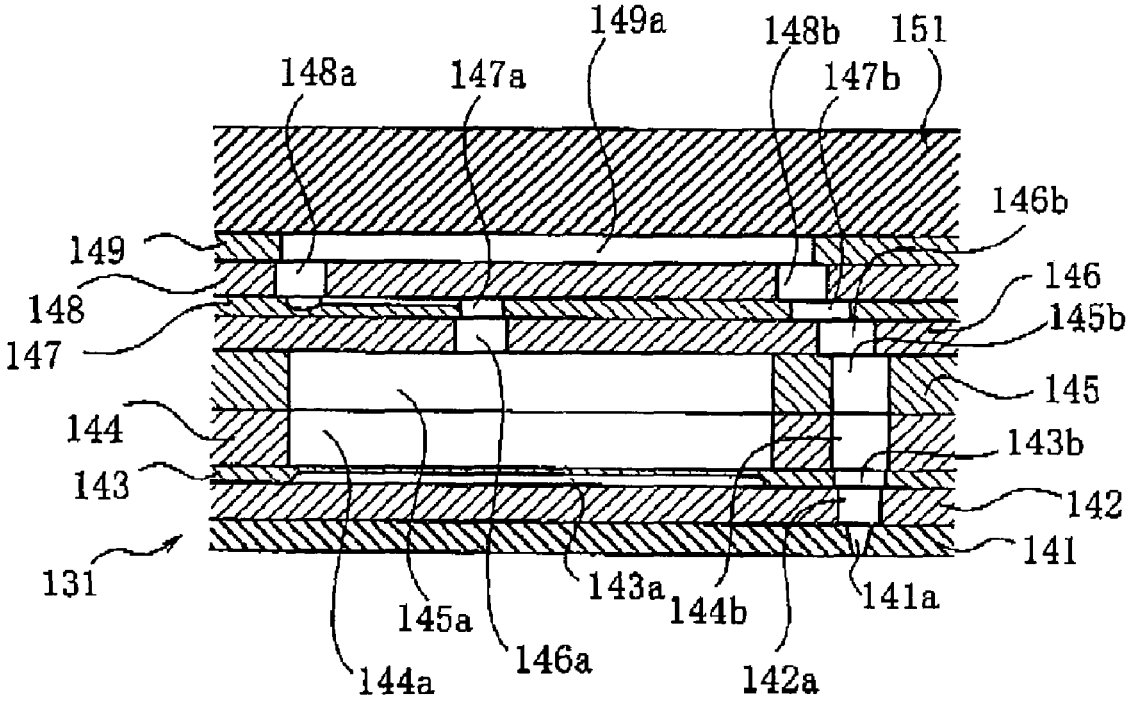
FIG. 10 is a cross-section view corresponding to FIG. 4, showing a conventional recording head.
Figure 11:
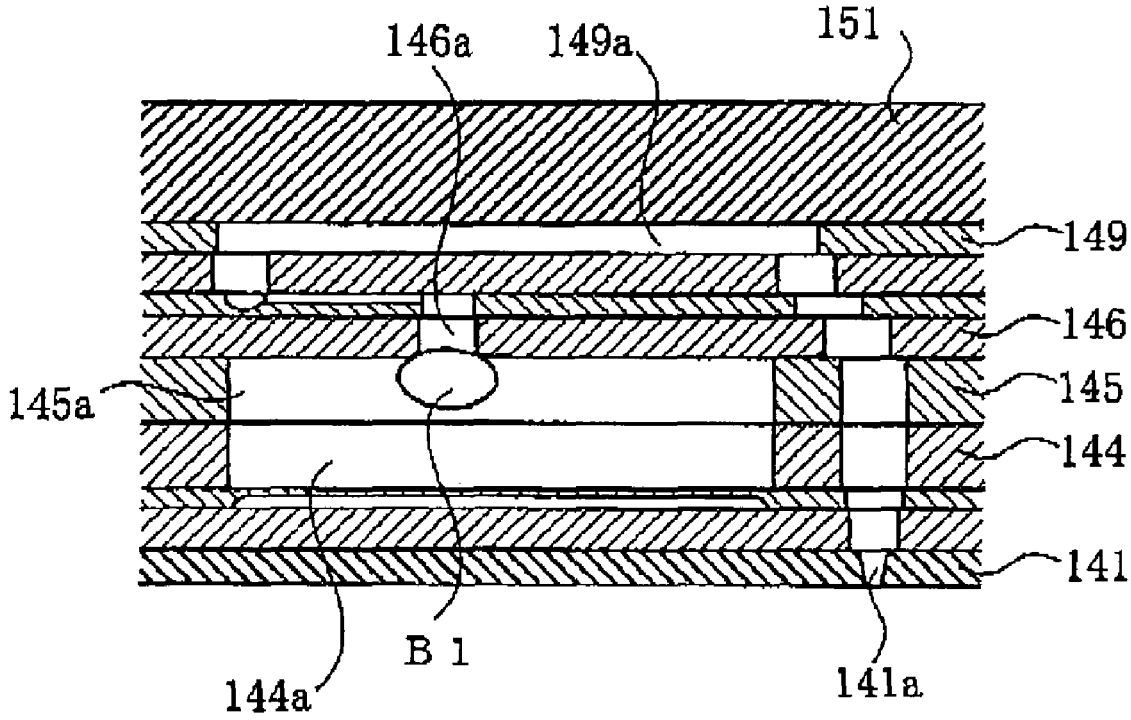
FIG. 11 is a cross-section view corresponding to FIG. 7, showing the conventional recording head.
Figure 12:
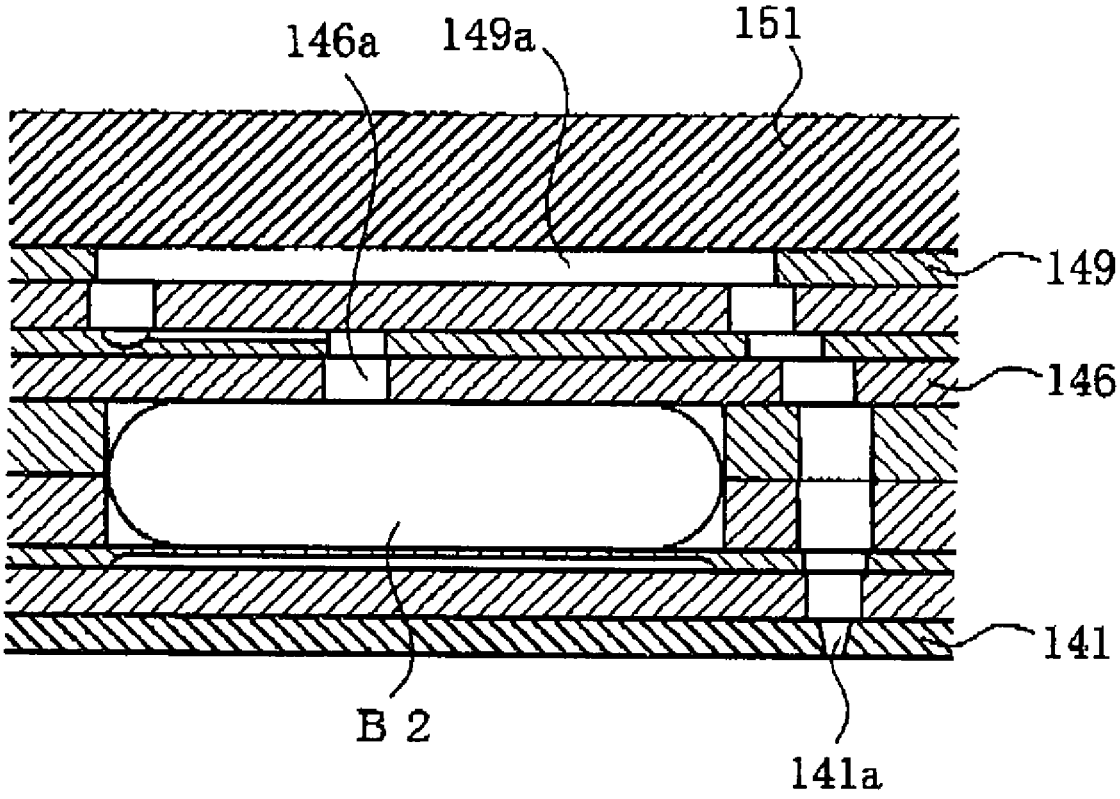
FIG. 12 is a cross-section view corresponding to FIG. 8, showing the conventional recording head.

The cavity unit 31 includes a nozzle sheet 41, and a stacked structure consisting of a plurality of stacked metallic sheets. Those metallic sheets include a spacer sheet 42; a damper sheet 43; two manifold sheets 44, 45; a supply sheet 46; an aperture sheet 47; a base sheet 48; and a cavity sheet 49, and are stacked on, and are bonded with an adhesive to, each other. Communication holes 46*a*, 48*a* and communication passages 47*a* through which the four pairs of manifold holes 44*a*, 45*a* communicate with the four arrays of pressure chambers 49*a*, respectively, are formed in the sheets 46, 48, 47; and communication holes 42*a*, 43*b*, 44*b*, 45*b*, 46*b*, 47*b*, 48*b* through which the four arrays of pressure chambers 49*a* communicate with the four arrays of nozzle holes 41*a*, respectively, are formed in the sheets 42, 43, 44, 45, 46, 47, 48. The damper sheet 43 has four recesses 43*a* functioning as damper chambers each of which damps vibration of the ink present in a corresponding one pair of manifold holes 44*a*, 45*a* out of the four pairs of manifold holes 44*a*, 45*a*. The four recesses 43*a* open toward the nozzle sheet 41, like the conventional recording head 101 shown in FIGS. 10, 11, and 12.

The four pairs of manifold holes 44*a*, 45*a* of the cavity unit 31 corresponding to the four color inks, respectively, are arranged side by side. As shown in FIG. 3, the cavity unit 31 has four ink supply holes 52 to which the four color inks are supplied from the four ink tanks, not shown, and which communicate with respective one ends of the four pairs of manifold holes 44*a*, 45*a*.

Figure 4:
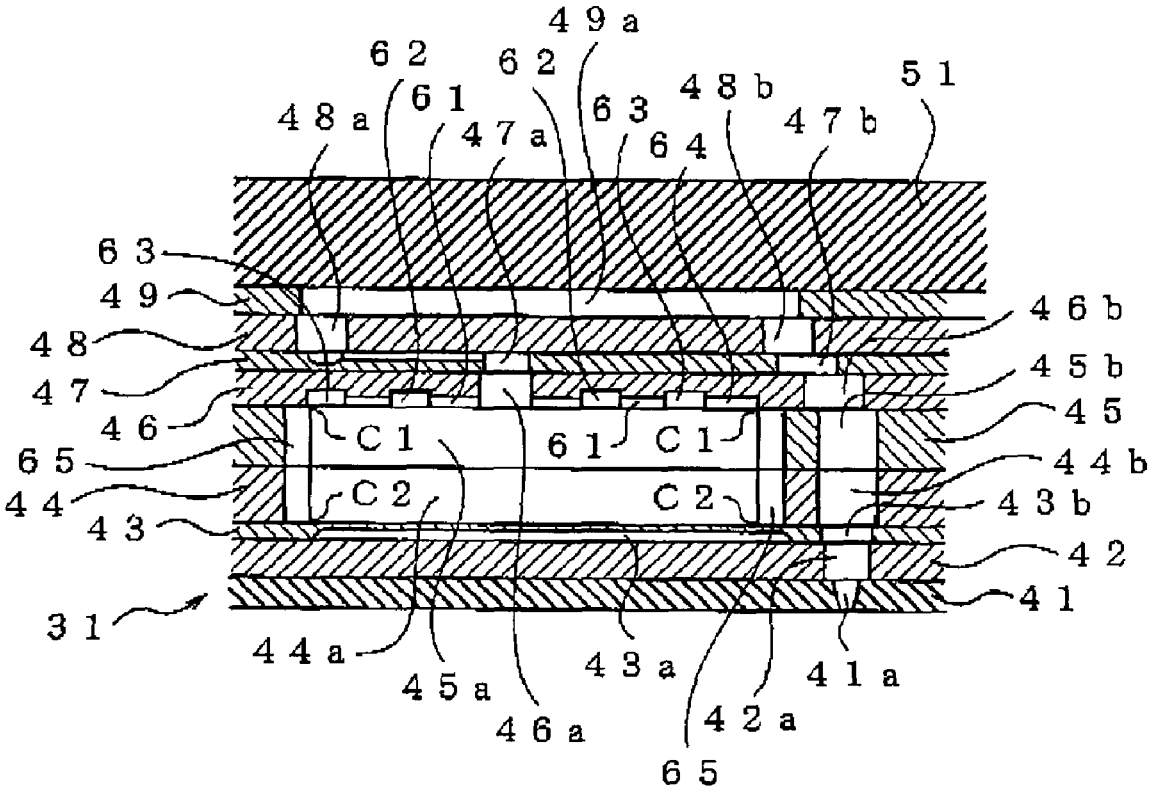
FIG. 4 is a cross-section view of the recording head.
Figure 5:
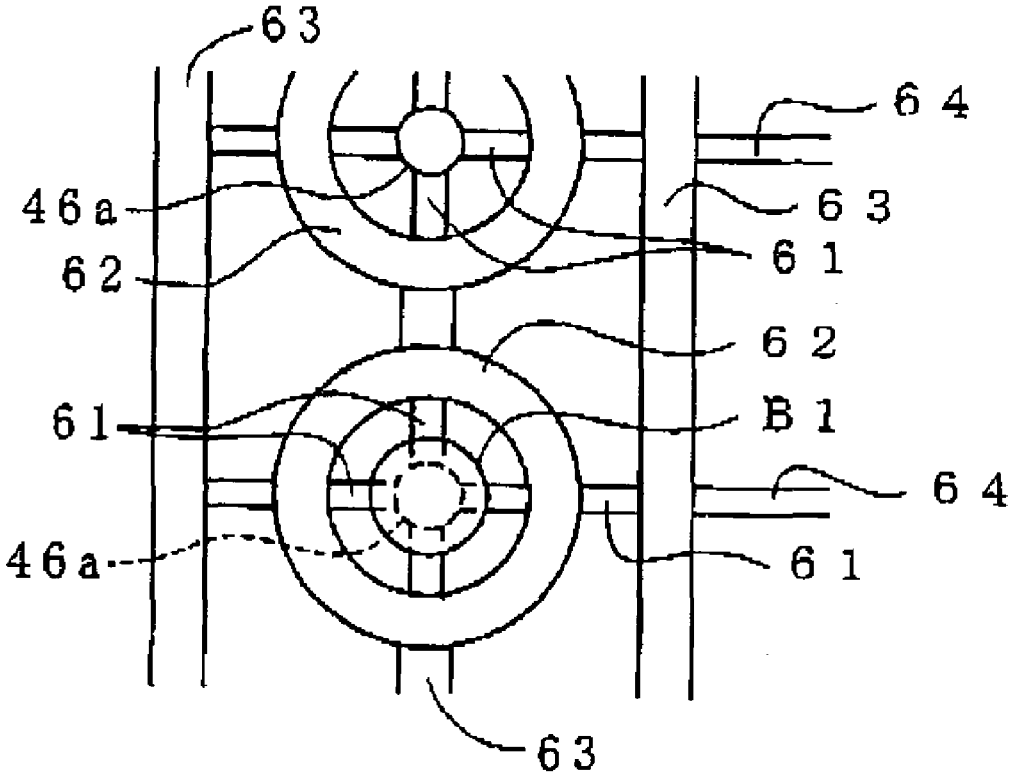
FIG. 5 is a plan view of grooves formed in an inner wall surface partly defining a manifold (i.e., a common ink chamber) of the cavity unit.
Figure 6:
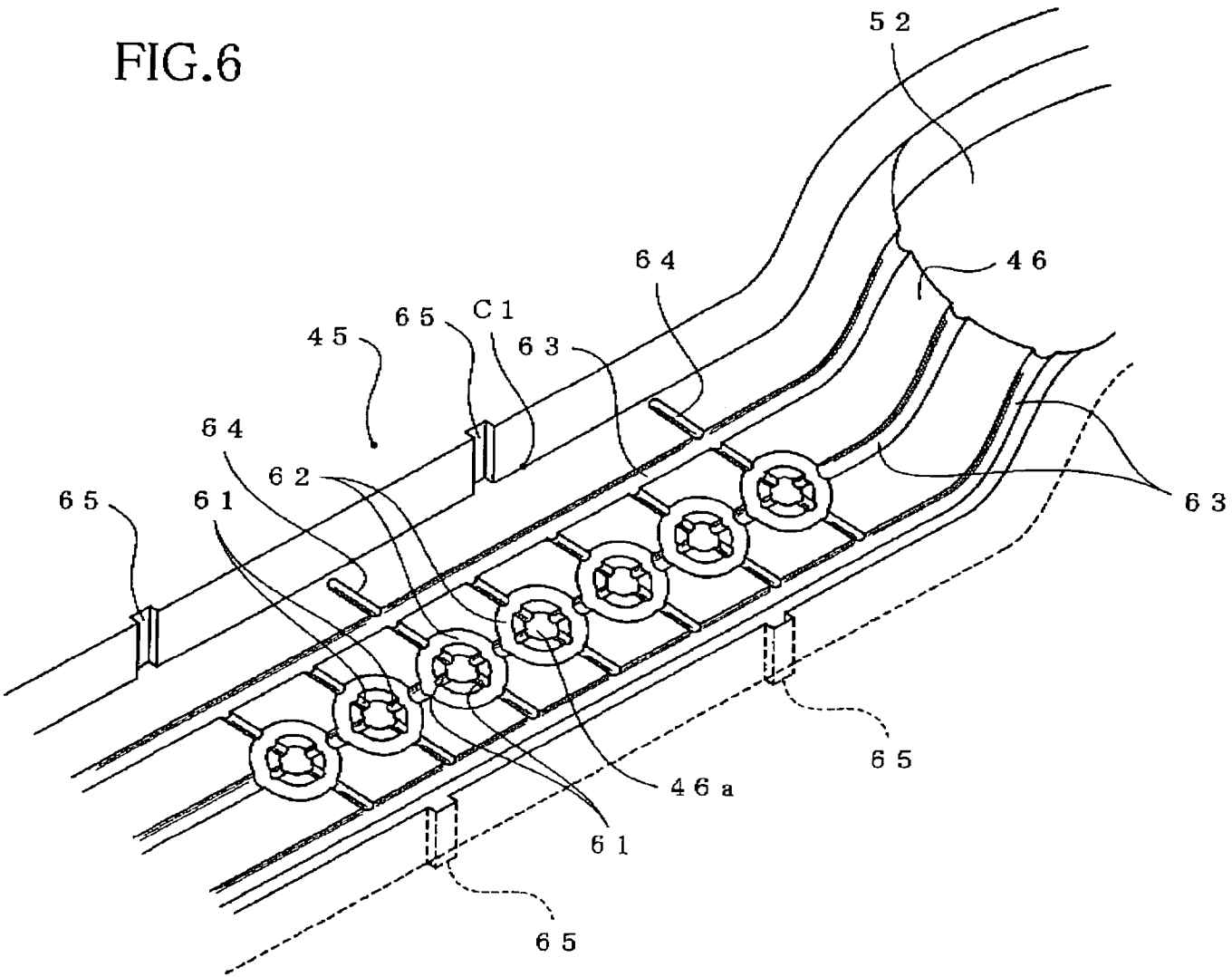
FIG. 6 is a perspective view of grooves formed in inner wall surfaces partly defining the manifold.

As shown in FIGS. 4 through 6, a lower surface of the supply sheet 46 includes four upper wall surfaces each of which partly defines a corresponding pair of manifold holes 44*a*, 45*a*, and has a corresponding array of communication holes 46*a* through which a corresponding one of the four color inks is supplied from the corresponding pair of manifold holes 44*a*, 45*a* to a corresponding array of pressure chambers 49*a*. As shown in FIGS. 5 and 6, each of the communication holes 46*a* communicates with a plurality of individual straight grooves 61 (e.g., four grooves 61 in the present embodiment) each of which has a semicircular cross-section shape and which extend radially outward from the each communication hole 46*a*. The plurality of groups of individual straight grooves 61 corresponding to the plurality of communication holes 46*a*, respectively, provide a plurality of groups of individual ink-flow grooves each group of which is associated with a corresponding one of the communication holes 46*a*. In addition, each of the communication holes 46*a* is surrounded by a corresponding one of a plurality of individual annular grooves 62, and the corresponding annular groove 62 intersects each of the above-indicated four straight grooves 61 communicating with the each communication hole 46*a*, so that the corresponding annular groove 62 communicates with the each communication hole 46*a* via the straight grooves 61. The plurality of individual annular grooves 62 provide a plurality of individual communication grooves, or a plurality of surrounding grooves.

The supply sheet 46 additionally has, for each pair of manifold holes 44*a*, 45*a* out of the four pairs of manifold holes 44*a*, 45*a* (hereinafter, referred to as each manifold 44*a*, 45*a*), a plurality of common communication grooves 63 (e.g., three grooves 63 in the present embodiment) that extend from an upstream-side portion of the each manifold 44*a*, 45*a* to a downstream-side portion of the same 44*a*, 45*a* and communicate, at respective upstream-side ends thereof, with a corresponding one of the four ink supply holes 52. Each of the common communication grooves 63 has a width greater than that of each of the individual straight grooves 61 or the individual annular groves 62. Each of the common communication grooves 63 intersects the individual straight grooves 61 and/or the individual annular groves 62, so as to communicate with each of the communication holes 46*a* via the straight grooves 61 and/or the annular grooves 62.

As shown in FIG. 4, each manifold 44*a*, 45*a* has a rectangular parallelepiped shape defined by upper and lower wall surfaces, i.e., the supply sheet 46 and the damper sheet 43, and two side wall surfaces, i.e., the lower and upper manifold sheets 44, 45. The supply sheet 46 as the upper wall surface cooperates with the upper manifold sheet 45 as respective upper half portions of the two side wall surfaces to define two upper corner portions, C1, and the supply sheet 46 has a plurality of straight guide grooves 64 that guide the ink around a right-hand one (in FIG. 4) of the two upper corner portions C1 toward the nearest one of the common communication grooves 63. Each of the straight guide grooves 64 has one end opening in the right-hand upper corner portion C1, and communicates, at the other end thereof, with the nearest common communication groove 63. As shown in FIG. 4, in the present embodiment, each of the communication holes 46*a* communicating with the pressure chambers 49*a*, respectively, opens in the lower surface of the supply sheet 46 as the upper wall surface of the each manifold 44*a*, 45*a*. Because of a manner in which respective elements of each ink supply channel including, e.g., a manifold 44*a*, 45*a*, a pressure chamber 49*a*, and a nozzle 41*a*, are located relative to each other, a communication hole 46*a* as another element of the each ink supply channel is located at a position biased from the center line of the each manifold 44*a*, 45*a* toward the left-hand side (in FIG. 4). In the left-hand upper corner portion C1 opposite to the right-hand upper corner portion C1, one of the common communication grooves 63 is provided. Since the guide grooves 64 reach the right-hand upper corner portion C1, the guide grooves 64 can reliably lead the ink remaining around the corner portion C1, toward the nearest common communication groove 63. However, in the case where the other grooves 61, 62, 63 than the guide grooves 64 have a sufficiently high ink-leading ability, the guide grooves 64 need not reach the upper corner portion C1, but may be located at such a position that is just so near to the same C1 as to be able to lead an appropriate amount of ink from the same C1.

Thus, the single or common supply sheet 46 has the individual straight grooves 61, the individual annular grooves 62, the common communication grooves 63, and the guide grooves 64 all of which cooperate with each other to provide a network of ink-flow grooves.

The damper sheet 43 as the lower wall surface cooperates with the lower manifold sheet 44 as respective lower half portions of the two side wall surfaces to define two lower corner portions, C2, that are opposed to the two upper corner portions C1, respectively, and are connected to the same C1, respectively, by a plurality of corner communication holes 65.

Figure 7:
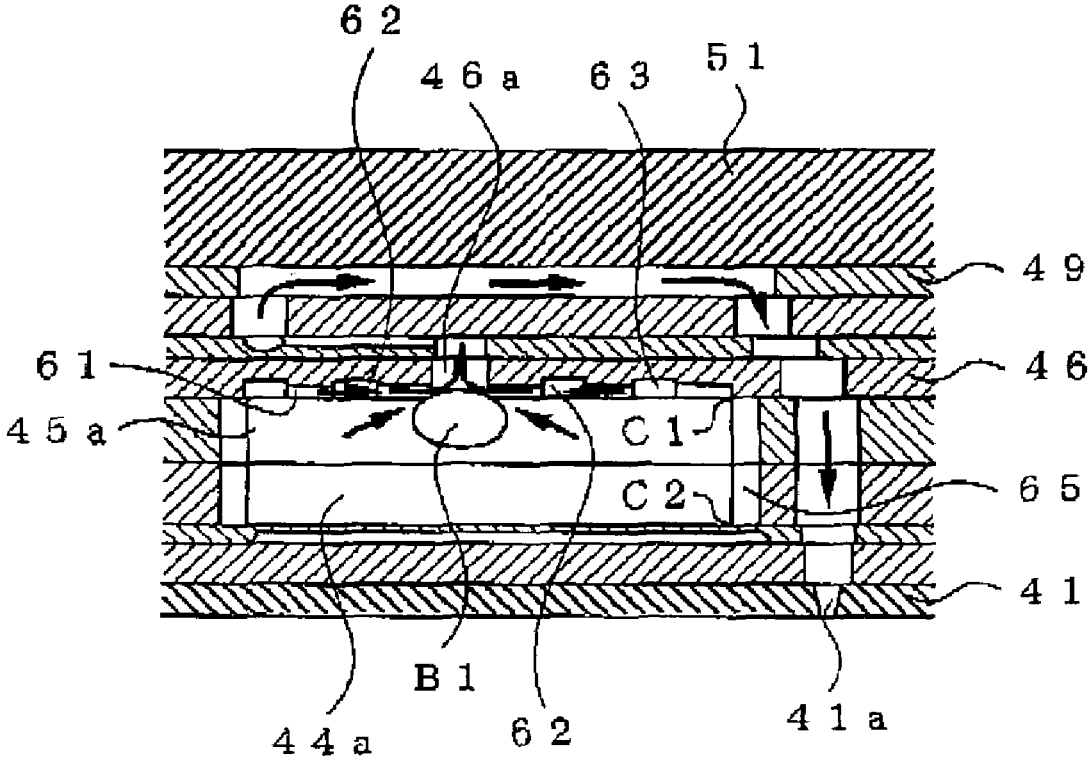
FIG. 7 is an illustrative view for explaining a manner in which ink flows through the manifold even when a small air bubble is present around a communication hole through which the manifold communicates with a pressure chamber.

In FIG. 7, symbol "B1" denotes a small air bubble that has a diameter of from 0.3 mm to 1.0 mm, flows from the upstream-side portion of each manifold 44*a*, 45*a*, and remains under each of the communication holes 46*a* of the supply sheet 46 that supplies the ink to a corresponding one of the pressure chambers 49*a*. In this case, however, the each communication hole 46*a* is supplied with the ink from the individual straight grooves 61, a corresponding one of the nozzles 41*a* can normally eject droplets of ink. Since the small air bubble B1 keeps a shape having the smallest surface area because of its surface tension, the air bubble B1 cannot completely block each of the individual straight grooves 61. Moreover, since the individual straight grooves 61 are connected to each other by the individual annular groove 62, and the individual straight and annular grooves 61, 62, associated with the each communication hole 46*a*, are connected to the other individual straight and annular grooves 61, 62, associated with the other communication holes 46*a*, by the common communication grooves 63, so as to provide the network of ink-flow grooves, the each communication hole 46*a* is reliably supplied with the ink. This network of ink-flow grooves 61, 62, 63 can deal with air bubbles B1 having various sizes. In addition, since the plurality of individual straight grooves 61 extend radially outward from the each communication hole 46*a*, the ink present around the air bubble 31 can be led to the each hole 46*a* over the shortest distance. Thus, irrespective of where the air bubbles B1 may be, the ink can be reliably supplied to all the communication holes 46*a*, so that all the nozzles 41*a* can normally eject droplets of the ink.

Figure 8:
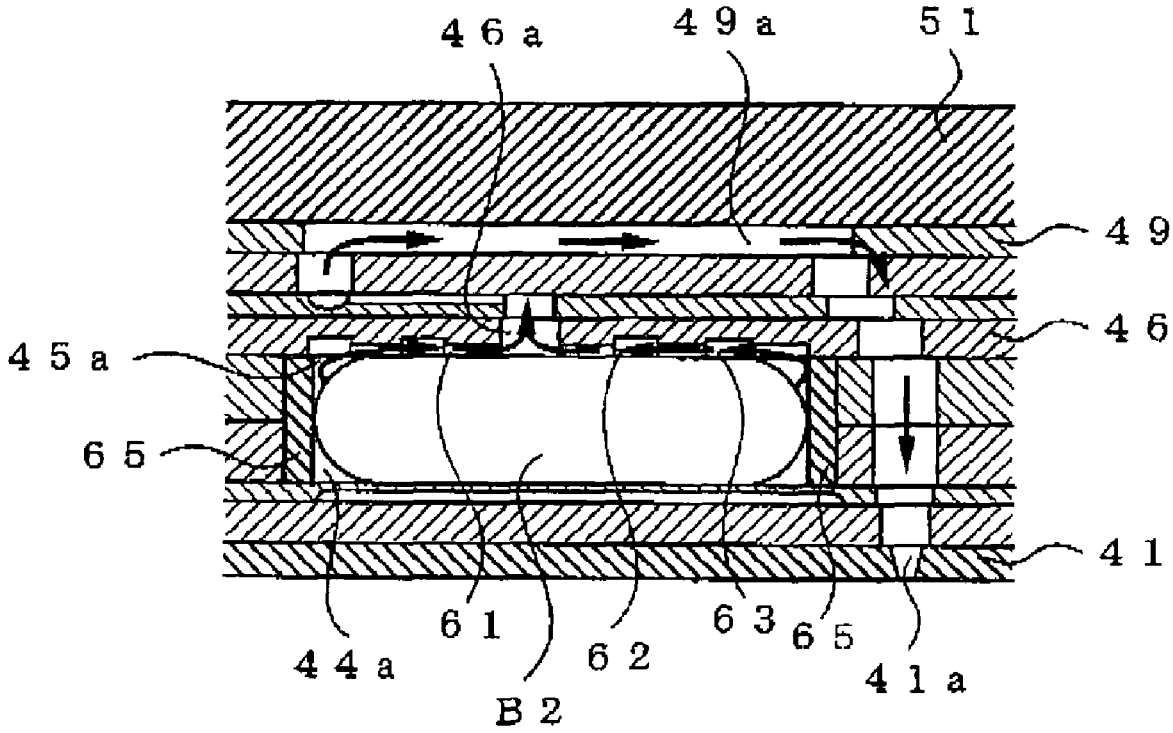
FIG. 8 is an illustrative view for explaining a manner in which the ink flows through the manifold even when a large air bubble is present in the manifold.

FIG. 8 shows such a large air bubble, B2, that blocks each manifold 44*a*, 45*a*. In this case, as the ink is consumed by the nozzle or nozzles 41*a* corresponding to the downstream-side communication hole or holes 46*a* located on the downstream side of the air bubble B2, the large air bubble B2 is moved toward the downstream-side portion of the each manifold 44*a*, 45*a*. As the air bubble B2 is moved downstream, the air bubble B2 is located under each of the downstream-side communication holes 46*a*, one after another. However, in this case, too, since each of the communication holes 46*a* is supplied with the ink from at least one of the straight grooves 61, a corresponding one of the nozzles 41*a* can normally eject droplets of the ink. More specifically described, even in the case where the large air bubble B2 blocks each manifold 44*a*, 45*a*, the ink present on the upstream and downstream sides of the air bubble B2, in particular, the ink present on the upstream side (i.e., on the side of the corresponding ink supply hole 52), can be supplied to the straight grooves 61 via the common communication grooves 63. However, if the lengths of the flow passages constituted by the network of the ink-flow grooves 61, 62, 63 increase, then the flow resistances of those passages also increase, so that the ink might not smoothly flow in the passages. In order to assure that each nozzle 41*a* can be supplied with a sufficient amount of ink, it is preferred to increase, e.g., the width and/or depth of each of the grooves 61, 62, 63 as the distance of the each groove 61, 62, 63 from the corresponding communication hole 46*a* increases, so that each portion of the each groove 61, 62, 63 may have a sufficiently high ink-supplying ability. To this end, in the present embodiment, the individual annular grooves 62 and the common communication grooves 63 have greater widths and depths than those of the individual straight grooves 61 directly connected to each communication hole 46*a*.

In addition, since the guide grooves 64 lead the ink present in the right-hand upper corner portion C1 (FIG. 4) and the corner communication grooves 65 lead the ink present in the two lower corner portions C2, that is, since the corner portions C1, C2 where the ink remains are communicated with (or connected to) the communication holes 46*a*, the ink can efficiently flow to the holes 46*a* even if the air bubbles B1, B2 may be present around the holes 46*a*. Thus, the pressure chambers 49*a* are smoothly supplied with the ink. This structure is particularly advantageous with respect to the downstream-side end portion of each manifold 44*a*, 45 where the air bubbles B1, B2 may remain for a long time. However, the downstream-side end portion of the each manifold 44*a*, 45 is supplied with the ink from more portions of the same 44*a*, 45*a* other than the end portion. Thus, the pressure chambers 49*a* corresponding to the downstream-side end portion of the each manifold 44*a*, 45 are more smoothly supplied with the ink. In the present embodiment, one of the three common communication grooves 63 extends along the left-hand upper corner portion C1 (FIG. 4), and this communication groove 63 contributes to stably supplying the ink to the communication holes 46*a* or the nozzles 41*a*.

In the illustrated embodiment, the annular grooves 62 (i.e., individual communication grooves) are formed, in the lower surface of the supply sheet 46, to surround the communication holes 46*a*, respectively, such that the straight grooves 61, connected to each of the communication holes 46*a*, communicate with each other through a corresponding one of the annular grooves 62. Therefore, if any of the straight grooves 61 is not closed or blocked by the air bubble B1, B2, the ink can flow through that straight groove 61 and can flow into the each communication hole 46*a* through the corresponding annular groove 62.

In the illustrated embodiment, the common communication grooves 63 are formed to extend in the manifold 44*a*, 45*a* (i.e., a common ink chamber) from the upstream-side portion thereof to the downstream-side portion thereof as seen in the direction in which the ink flows, and the groups of straight grooves 61 corresponding to the communication holes 46*a*, respectively, and/or the annular grooves 62 corresponding to the communication holes 46*a*, respectively, communicate with each other through the common communication grooves 63. That is, the common communication grooves 63 are formed to extend in the direction of flow of the ink in the manifold 44*a*, 45*a*, and the groups of straight grooves 61 and/or the annular grooves 62 communicate with each other through the common communication grooves 63. Thus, the ink can naturally or smoothly flow into each of the communication holes 46*a*.

In the illustrated embodiment, the lower surface of the supply sheet 46, the upper surface of the damper sheet 43, and the respective inner surfaces of the two manifold sheets 44, 45 cooperate with each other to define each manifold 44*a*, 45*a* as the common ink chamber, and the lower surface of the supply sheet 46 has the respective open ends of the communication holes 46*a*, and cooperates with the inner surface of the upper manifold sheet 45 to define the two upper corner portions C1. The lower surface of the supply sheet 46 further has the guide grooves 64 each of which has two opposite ends one of which opens in one of the two upper corner portions C1 and the other of which opens in one of the common communication grooves 63 so that the ink flows from the one upper corner portion C1 to the one common communication groove 63. As described above, the air bubble B1, B2 keeps its spherical shape because of its surface tension and accordingly the ink is always present in the corner portions C1. Therefore, even if the large air bubble B2 may stay in the manifold 44*a*, 45*a*, the ink can smoothly flow into each of the communication holes 46*a*.

In the illustrated embodiment, the respective inner surfaces of the upper and lower manifold sheets 44, 45 cooperate with the upper surface of the damper sheet 43 to define the two lower corner portions C2 which are opposed to the two upper corner portions C1, respectively; and those inner surfaces have the corner communication grooves 65 each of which has two opposite ends one of which opens in a corresponding one of the two lower corner portions C2 and the other of which opens in a corresponding one of the two upper corner portions C1 so that the ink can easily flow from the corresponding lower corner portion C2 to the corresponding upper corner portion C1.

While the present invention has been described in its preferred embodiment, the present invention may be embodied in different manners.

Figure 9A:
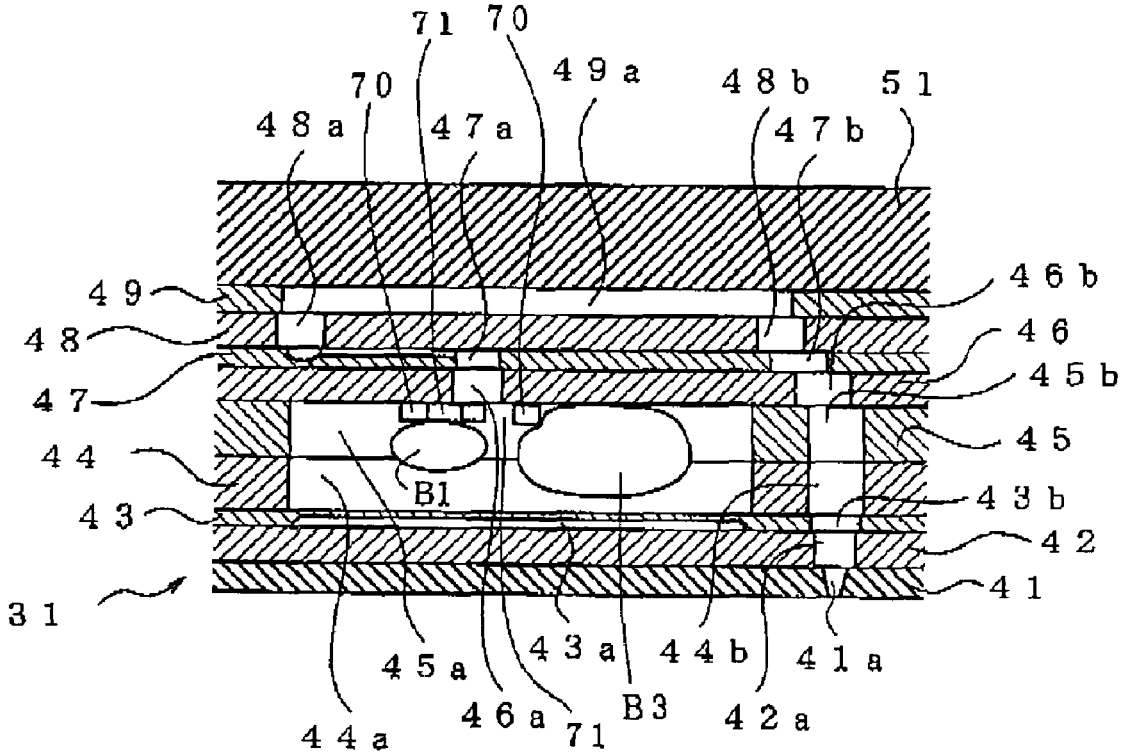
FIG. 9A is a cross-section view corresponding to FIG. 4, showing another recording head as a second embodiment of the present invention.
Figure 9B:
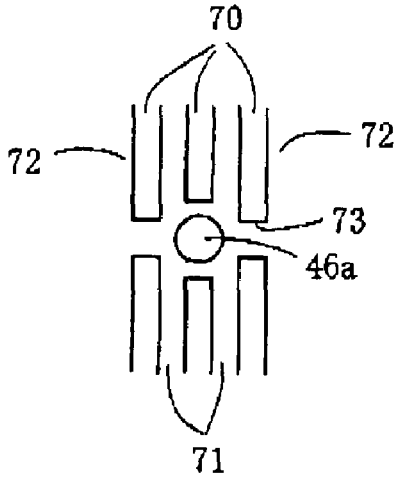
FIG. 9B is a plan view corresponding to FIG. 5, showing a plurality of ridges formed in an inner wall surface partly defining a manifold of the cavity unit of the second embodiment.

(i) In the above-described embodiment, the supply sheet 46 and the manifold sheets 44, 45 as the upper and side wall surfaces defining each manifold 44*a*, 45*a* have the ink-flow grooves 61, 62, 63, 64, 65 as elongate recesses formed in the respective surfaces of the sheets 46, 44, 45, for the purpose of leading the ink to the communication holes 46*a* that supply the ink to the pressure chambers 49*a*. However, as shown in FIGS. 9A and 9B, the supply sheet 46 and/or the manifold sheets 44, 45 may have, in place of, or addition to, the elongate recesses 61, 62, 63, 64, 65, a plurality of ridges, e.g., straight ridges 70 and/or annular ridges that project into each manifold 44*a*, 45*a*. Since the small air bubble B1 or a medium air bubble B3 keeps a shape having the smallest surface area because of its surface tension, the air bubble B1, B3 cannot fully block flows of ink through elongate grooves 71 and elongate spaces 72 each extending in the ink-flow direction in which the ink flows in the manifold 44*a*, 45*a*, and an elongate communication groove 73 extending in a direction perpendicular to the ink-flow direction. Each of the elongate grooves 71, 73 and the elongate spaces 72 is defined by, and between, the lower surface of the supply sheet 46 and one or two ridges 70. In FIGS. 9A and 9B, the two elongate grooves 71 and the two elongate spaces 72 communicate with each other through the elongate communication groove 73 communicating with the communication hole 46*a*. Thus, the ink can reliably flow into the communication hole 46*a* even if the air bubble B1, B3 may present around the hole 46*a*.

(ii) The individual straight grooves 61 may be additionally formed in the upper surface of the damper sheet 43 as the lower wall surface defining each manifold 44*a*, 45*a* and/or the respective inner surfaces of the two manifold sheets 44, 45 as the two side wall surfaces. However, it is not required that all the individual straight grooves 61 associated with each of the communication holes 46*a* be directly communicated with the each hole 46*a*, so long as at least one of the individual straight grooves 61 is directly communicated with the each hole 46*a*.

(iii) Each of the communication holes 46*a* may be communicated with individual grooves that are not straight unlike the straight grooves 61, so long as those individual grooves open in the each communication hole 46*a*. The elongate recesses 61, 62, 63, 64, 65 and/or the elongate spaces 71, 72 may not be continuous, i.e., may be discontinuous. In the latter case, recesses and/or spaces having different lengths, sizes and/or shapes may be used in combination with each other.

Thus, each of the communication holes 46*a* may be surrounded by the elongate recesses 61-65 and/or the elongate spaces 71, 72 such that respective one ends of the recesses and/or spaces open in the each communication hole 46*a* and the recesses and/or spaces are communicated with each other by one or more common communication grooves 63 formed in the wall surface defining each manifold 44*a*, 45*a*.

The annular grooves 62 may be replaced with different individual communication grooves that do not have a circular shape, so long as each of those individual communication grooves substantially surrounds a corresponding one of the communication holes 46*a*. Thus, each of the communication holes 46*a* may be surrounded by a single continuous communication groove like a closed loop, or a plurality of discontinuous grooves.

In the illustrated embodiment, the communication holes 46*a* are formed in the supply sheet 46 as the upper wall surface defining each manifold 44*a*, 45*a*, as shown in FIG. 4. However, the communication holes 46*a* may be formed in the damper sheet 43 and/or the manifold sheets 44, 45, depending upon a specific manner in which the ink flow channels are formed in the cavity unit 31. Wherever the communication holes 46*a* may open in the each manifold 44*a*, 45*a*, each of the communication holes 46*a* can be surrounded by the above-described grooves 61, 62, 63 and, additionally, the grooves 64, 65, so that the ink around the each hole 46*a* can be lead and supplied to the each hole 46*a* via those grooves 61, 62, 64, 64, 65.

It is to be understood that the present invention may be embodied with various changes, modifications, and improvements that may occur to a person skilled in the art without departing from the spirit and scope of the invention defined in the appended claims.

What is claimed is:

1. A recording head for use in an inkjet recording device, the recording head comprising:

a cavity unit having a plurality of nozzles each of which ejects a droplet of an ink, a plurality of communication holes which communicate with the plurality of nozzles, respectively, and a common ink chamber which communicates, in the cavity unit, with each of the communication holes and which temporarily stores the ink to be supplied to said each of the nozzles via a corresponding one of the communication holes;

wherein the cavity unit has a plurality of inner wall surfaces which cooperate with each other to define the common ink chamber and which comprise, in a state in which the recording head is used in the inkjet recording device, (a) an upper wall surface having respective open ends of the communication holes and (b) a lower wall surface opposed to the upper wall surface;

wherein the upper wall surface further has a plurality of grooves each of which is connected, at one end thereof, to the open end of a corresponding one of the communication holes such that said each groove has, in at least a vicinity of said open end, a width smaller than a dimension of said open end in a direction of said width of said each groove;

wherein the plurality of grooves comprise a plurality of groups of individual ink-flow grooves each group of which is associated with a correspond one of the plurality of communication holes, such that the individual grooves of said each group are formed around said corresponding communication hole and are connected, at respective one ends thereof, to the open end of said corresponding communication hole; and wherein the upper wall surface further has a plurality of individual communication grooves each of which is associated with a corresponding one of the plurality of communication holes, such that said each individual communication groove is not directly connected to said corresponding communication hole and the individual ink-flow grooves of said each group communicate with each other through a corresponding one of the individual communication grooves.

2. The recording head according claim 1;

wherein the cavity unit further has a plurality of individual ink chambers which communicate, at respective one ends thereof, with the plurality of nozzles, respectively, and communicate, at respective other ends thereof, with the plurality of communication holes, respectively; and wherein the recording head further comprises an actuator which changes a pressure of the ink present in each of the individual ink chambers so that a corresponding one of the nozzles ejects the droplet of the ink.

3. The recording head according claim 1;

wherein the grooves comprise at least one of (a) an elongate recess formed in the upper wall surface and (b) an elongate space defined by, and between, the upper wall surface and an elongate ridge formed thereon.

4. The recording head according to claim 1;

wherein the individual communication grooves comprise a plurality of surrounding grooves each of which is formed to surround a corresponding one of the communication holes.

5. The recording head according to claim 1;

wherein, in the state in which the recording head is used in the inkjet recording device, said each of the nozzles opens in a lower, outer surface of the cavity unit so as to eject the droplet of the ink in a downward direction.

6. The recording head according to claim 4;

wherein the upper wall surface has, in addition to the groups of individual ink-flow grooves and the individual communication grooves, at least one common communication groove which extends, in the common ink chamber, from an upstream-side portion thereof toward a downstream-side portion thereof in a direction in which the ink flows; and wherein at least one of (a) the groups of individual ink-flow grooves and (b) the individual communication grooves communicate with each other through said at least one common communication groove.

7. The recording head according claim 6;

wherein the plurality of inner wall surfaces include, in addition to the upper wall surface having the respective open ends of the communication holes, a side wall surface which cooperates with the upper wall surface to define a first corner portion; and wherein the upper wall surface further has at least one guide groove which has two opposite ends one of which opens in the first corner portion and an other of which opens in said at least one common communication groove.

8. The recording head according claim 7;

wherein the side wall surface cooperates with the upper wall surface and the lower wall surface to define the first corner portion and a second corner portion opposed to the first corner portion; and wherein the side wall surface has at least one corner communication groove through which the first and second corner portions communicate with each other.

9. A recording head for use in an inkjet recording device, the recording head comprising:

a cavity unit having a plurality of nozzles each of which ejects a droplet of an ink, a plurality of communication holes which communicate with the plurality of nozzles, respectively, and a common ink chamber which communicates, in the cavity unit, with each of the communication holes and which temporarily stores the ink to be supplied to said each of the nozzles via a corresponding one of the communication holes;

wherein the cavity unit has a plurality of inner wall surfaces which cooperate with each other to define the common ink chamber and which comprise, in a state in which the recording head is used in the inkjet recording device, (a) an upper wall surface having respective open ends of the communication holes and (b) a lower wall surface opposed to the upper wall surface;

wherein the upper wall surface further has a plurality of groups of straight ink-flow grooves, and the straight ink-flow grooves of each of the groups are connected, at respective one ends thereof, to the open end of a corresponding one of the communication holes such that the straight ink-flow grooves of said each group extend radially outward from the open end of said corresponding communication hole;

wherein each of the straight ink-flow grooves has a width smaller than a dimension of said open end in a direction of said width of said each straight ink-flow groove; and wherein the upper wall surface further has a plurality of annular grooves each of which is formed to surround a corresponding one of the communication holes, such that the straight ink-flow grooves of said each group, connected to said corresponding communication hole, communicate with each other through a corresponding one of the annular grooves.

10. The recording head according to claim 9;

wherein the cavity unit further has a plurality of individual ink chambers which communicate, at respective one ends thereof, with the plurality of nozzles, respectively, and communicate, at respective other ends thereof, with the plurality of communication holes, respectively; and wherein the recording head further comprises an actuator which changes a pressure of the ink present in each of the individual ink chambers so that a corresponding one of the nozzles ejects the droplet of the ink.

11. The recording head according to claim 9;

wherein the upper wall surface further has at least one common communication groove which extends, in the common ink chamber, from an upstream-side portion thereof toward a downstream-side portion thereof in a direction in which the ink flows; and wherein at least one of (a) the groups of straight ink-flow grooves and (b) the annular grooves communicate with each other through said at least one common communication groove.

12. The recording head according to claim 11;

wherein the plurality of inner wall surfaces include, in addition to the upper wall surface and the lower wall surface, a side wall surface which cooperates with the upper and lower wall surfaces to define the common ink chamber;

wherein the upper wall surface has the respective open ends of the communication holes, and cooperates with the side surface to define a first corner portion; and wherein the upper wall surface further has at least one guide groove which has two opposite ends one of which opens in the first corner portion and an other of which opens in said at least one common communication groove.

13. The recording head according to claim 12;

wherein the side wall surface cooperates with the upper wall surface and the lower wall surface to define the first corner portion and a second corner portion opposed to the first corner portion; and wherein the side wall surface has at least one corner communication groove through which the first and second corner portions communicate with each other.

* * * * *